US005242023A

United States Patent [19]

Terry et al.

[11] Patent Number: 5,242,023

[45] Date of Patent: Sep. 7, 1993

[54] METHOD AND APPARATUS FOR DELIVERING COMPRESSED PARTICULATE SOLID FIRE FIGHTING AGENT

[76] Inventors: Roy D. A. Terry, Apartment 13, 6900 W. 25th Ave., Edgewater, Colo. 80215; Roger G. Terry, 352 S. Tucson Way, Aurora, Colo. 80012

[21] Appl. No.: 944,395

[22] Filed: Sep. 14, 1992

[51] Int. Cl.[5] ..... A62C 31/02

[52] U.S. Cl. ..... 169/43; 169/46; 169/47; 169/70; 169/9; 239/590

[58] Field of Search ..... 169/43, 44, 46, 47, 169/70, 74, 77, 9, 52, 24; 239/590, 590.5, 343, 432, 373, 654

[56] References Cited

FOREIGN PATENT DOCUMENTS

| | | | |
|---|---|---|---|
| 2335680 | 1/1975 | Fed. Rep. of Germany | 169/24 |
| 3634451 | 4/1989 | Fed. Rep. of Germany | 169/77 |
| 2195483 | 6/1982 | France | 169/77 |
| 820840 | 4/1981 | U.S.S.R. | 169/24 |
| 955953 | 9/1982 | U.S.S.R. | 169/77 |
| 1340765 | 9/1987 | U.S.S.R. | 169/77 |

*Primary Examiner*—David M. Mitchell
*Assistant Examiner*—James M. Kannofsky

[57] ABSTRACT

An improved method and apparatus for delivering compressed particulate solid fire fighting agent includes a pneumatic system for entraining particulate fire fighting agent in a high pressure gas stream, compressing the agent into quasi-discrete quasi-solid slugs, and delivering the compressed slugs in a constant stream at a high rate of speed to the center of the fire being fought from a safe distance. The system includes a high pressure gas supply, a pressure regulator, a pressure compensator, a pressure sink, an agent storage vessel, and a multi-stage delivery nozzle including a pressure imbalance mechanism. Particulate agent is sequentially compressed in the multiple nozzle stages by virtue of a pulsating gas supply effect, and ejected in a constant stream of solid slugs at speeds near or above Mach 1.

18 Claims, 5 Drawing Sheets

METHOD AND APPARATUS FOR DELIVERING COMPRESSED PARTICULATE SOLID FIRE FIGHTING AGENT

BACKGROUND OF THE INVENTION

1. Field Of The Invention

The present invention relates to fire fighting agent application, and more particularly pertains to an improved method and apparatus for delivering compressed particulate solid fire fighting agent.

1. Description Of The Prior Art

Prior art devices have attempted to employ pressure gas streams to entrain and deliver solid particulate fire fighting agents. Due to ambient air resistance, turbulence and varying pressures created by the fire being fought, nozzle cavitation, gas slippage through delivery hoses and nozzles, and other problems, the prior art systems have been found unable to deliver effective quantities of fire fighting agent for large fire involvements from safe distances. Prior art systems merely spray the particulate agent in a loose cloud into the periphery of the fire, and as such fail to generate sufficient kinetic energy to project the agent particles for sufficient distances. The tremendous heat of a typical structural fire creates high wind currents and turbulence, which disrupt and render such loose agent clouds ineffective.

SUMMARY OF THE INVENTION

In order to overcome these problems and achieve other objects of the invention, the present invention provides an improved method and apparatus for delivering compressed particulate solid fire fighting agent which includes a pneumatic system for entraining particulate fire fighting agent in a high pressure gas stream, compressing the agent into quasi-discrete quasi-solid slugs, and delivering the compressed slugs in a constant stream at a high rate of speed to the heart center of the fire being fought from a safe distance. After such delivery, the slugs bloom into clouds of particulate agent within the fire envelope, effecting a massive endothermic reaction and thereby controlling or extinguishing the fire. The system includes a high pressure gas supply, pressure regulators, a pressure compensator, a pressure sink, an agent storage vessel, and a multi-stage delivery nozzle including a pressure imbalance mechanism. Particulate agent is sequentially compressed in the multiple nozzle stages by virtue of a pulsating gas supply effect, and ejected in a constant stream of solid slugs at speeds near or above Mach 1.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT(S)

Figure 1:
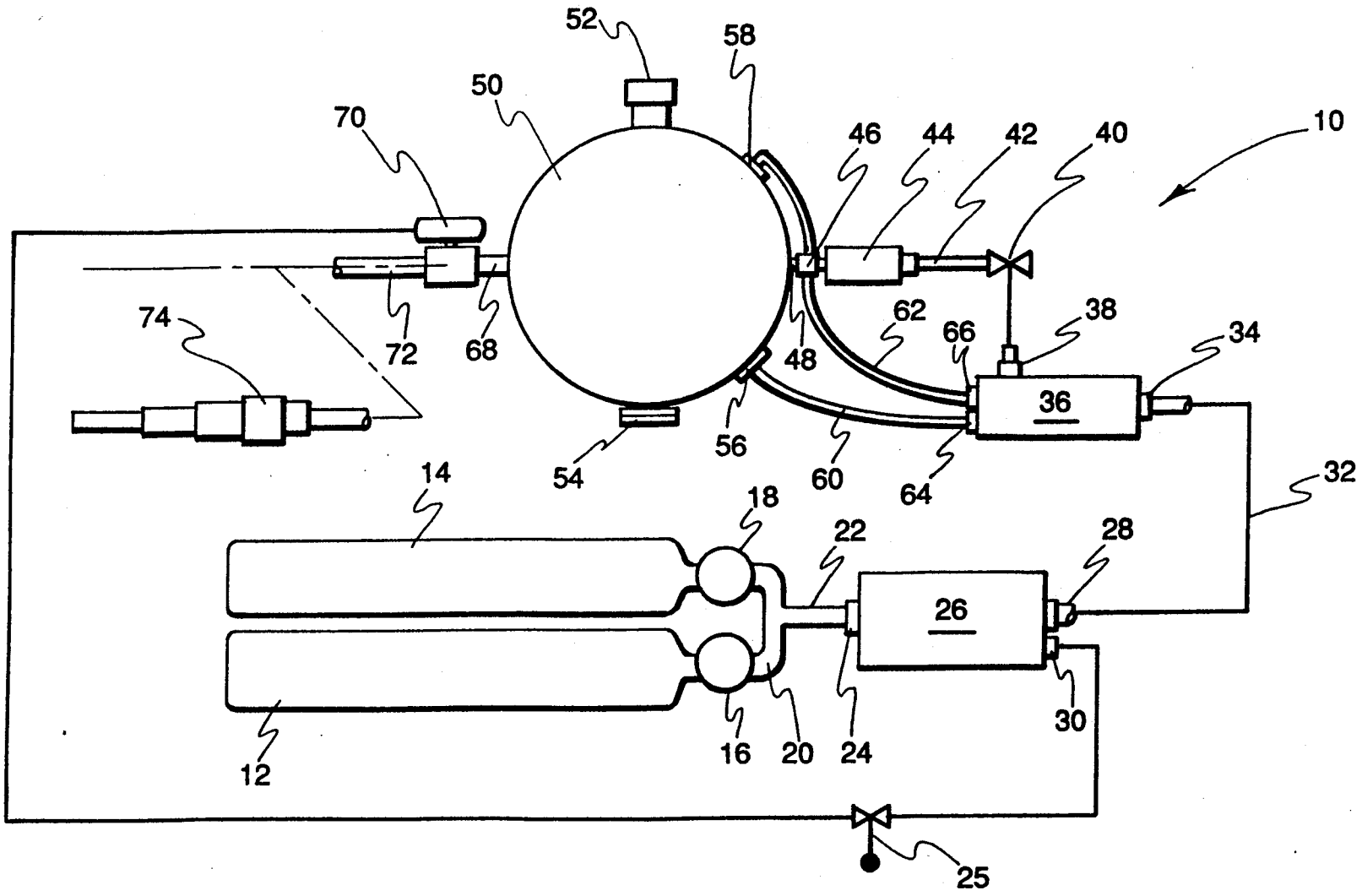
FIG. 1 is a schematic flow diagram illustrating the apparatus for delivering compressed particulate solid fire fighting agent according to a preferred embodiment of the present invention.

Referring now to the drawings, wherein like reference numerals designate corresponding structure throughout the views, and referring in particular to FIG. 1, the improved apparatus for delivering compressed particulate solid fire fighting agent 10 according to a first preferred embodiment of the invention includes a required number of conventional high pressure gas tanks, for example a pair of tanks 12 and 14 filled with nitrogen gas at a high pressure, for example in the range of 3500 to 5000 psi. Outlets of tanks 12 and 14 are connected by conventional valves 16 and 18 to a manifold 20 providing a high pressure input via line 22 to the inlet port 24 of a conventional pressure regulators 26. Regulators 26 preferably includes low, medium, and high pressure stages possessing respective outlet pressure ranges of 50 to 80 psi, 280 to 300 psi, and 320 to 420 psi. The regulators 26 are wide available conventional items, with one suitable regulator being manufactured Globe in a variety of different flow rate specifications to accommodate different size units. A high pressure outlet 28 from regulators 26 is connected by line 32 to the inlet 34 of a pressure compensator 36, to be described subsequently in greater detail. Compensator 36 provides three equal pressure outlets 38, 64, and 66. Outlet 38 feeds the inlet 42 of a pressure sink 44 via a valve 40. An outlet 46 of the pressure sink 44 feeds an inlet 48 of a spherical agent storage vessel 50. The agent storage vessel 50 includes a clean out access port 54 which also functions as an agent reservoir, and a fill cap 52. Agent storage vessel pressure inlets 56 and 58 are connected by lines 60 and 62 to outlets 64 and 66 of compensator 36. An outlet 68 from vessel 50 is connected via valve 70 and line 72 to a delivery nozzle 74.

Valve 40 is a pneumatic valve of the type operative to close upon equalization of pressure between sink 44 and vessel 50. Suitable valves are widely available commercially, with one suitable type being manufactured by National in a variety of different sizes depending upon the volumetric flow rates desired. Valve 70 is a pneumatically operated open/close valve controlled by gas pressure from the low pressure stage outlet 30 of regulator 26 via a manual control valve 25. A variety of suitable valve useable for valve 70 are available commercially, with one type being manufactured by National.

In operation, nitrogen gas from tanks 12 and 14 passes through regulator 26 and compensator 36 to vessel 50 where stored solid particulate fire fighting agent is entrained and subsequently exhausted at a high speed (Mach 1 or above) through delivery nozzle 74. Suitable fire fighting agents are known in the trade as MAP - monoammonium phosphate and/or sodium carbonate base P.K., which are of fine powder consistency (40 to 100 microns). These agents typically include small amounts of silicone, on the order of 2.0 percent by weight. In accordance with the present invention, the amount of silicone is preferably increased to 4.0 to 4.5 percent by weight, in order to increase the binding of the solid agent particles due to scarifying of the silicone upon frictional heating of the delivery nozzle. The nozzle 74, compensator 36, sink 44, and agent storage vessel 50 components of the invention cooperate to provide a pulsating effect, resulting in the delivery of the solid particulate fire fighting agent in quasi-discrete compacted quasi-solid slugs traveling in a constant stream at a high rate of speed. The terms quasi-discrete and quasi-solid are used herein to define a stream of compacted particulate projectiles traveling in a high velocity stream, closely spaced, and in practice separated by a small amount of uncompacted loose particulate agent. The slugs are not entirely solid, and they will return to a loose particulate cloud after being shot into the heart of the fire.

Figure 2:
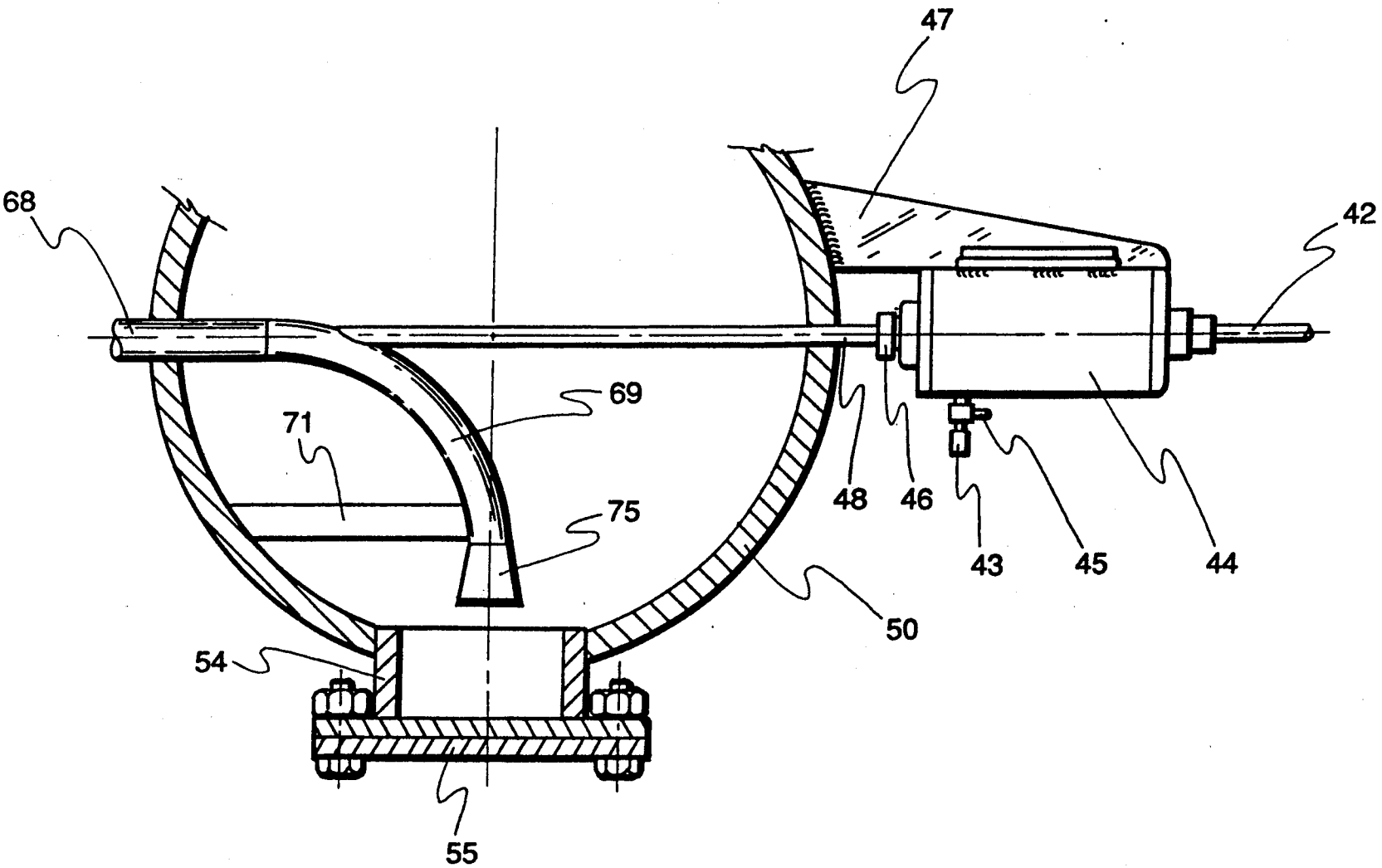
FIG. 2 is a partial cross sectional detail view illustrating the agent storage vessel and pressure sink components of the invention.

With reference to FIG. 2, the agent storage vessel 50 includes a mounting flange or bracket 47 by which pressure sink 44 is mounted. Outlet 46 of sink 44 is connected in fluid communication with an agent entrainment tube 69 within vessel 50. A reinforcement strut 71 supports a conically flared entrainment spout 75 of tube 69 above an agent reservoir 54. In operation, vessel 50 will be initially substantially entirely filled with a fine solid particulate fire fighting agent and mounted to a suitable supporting base 55, for example on a fire fighting vehicle.

Figure 4:
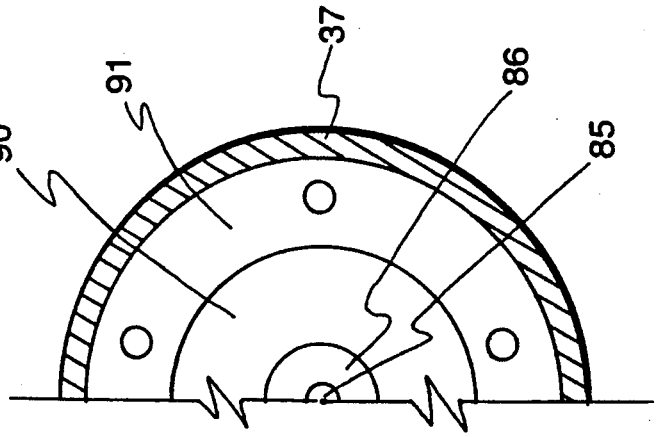
FIG. 4 is a transverse cross-sectional view taken along line 4—4 of FIG. 3 further illustrating the pressure compensator.
Figure 3:
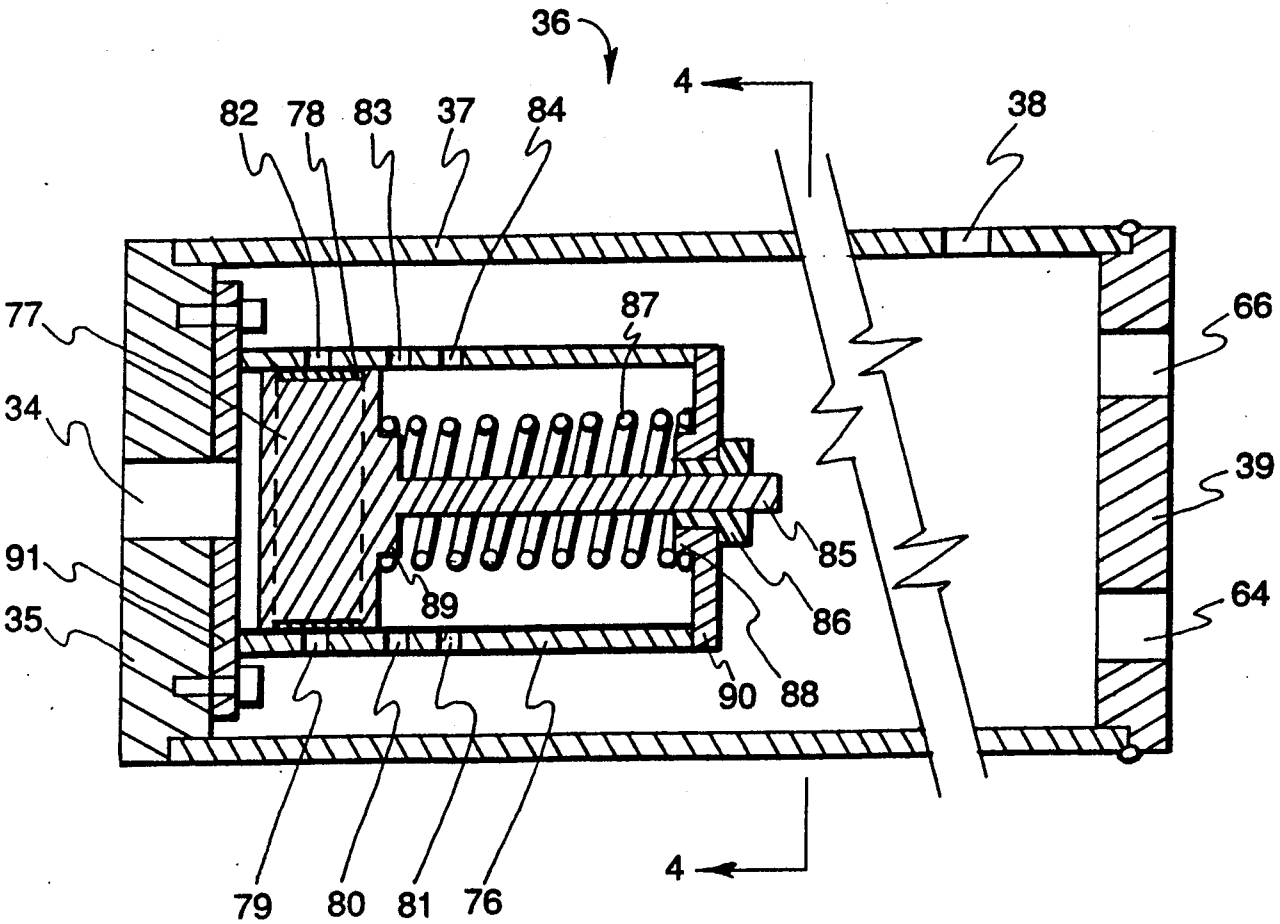
FIG. 3 is a longitudinal cross-sectional view illustrating the pressure compensator.
Figure 5:
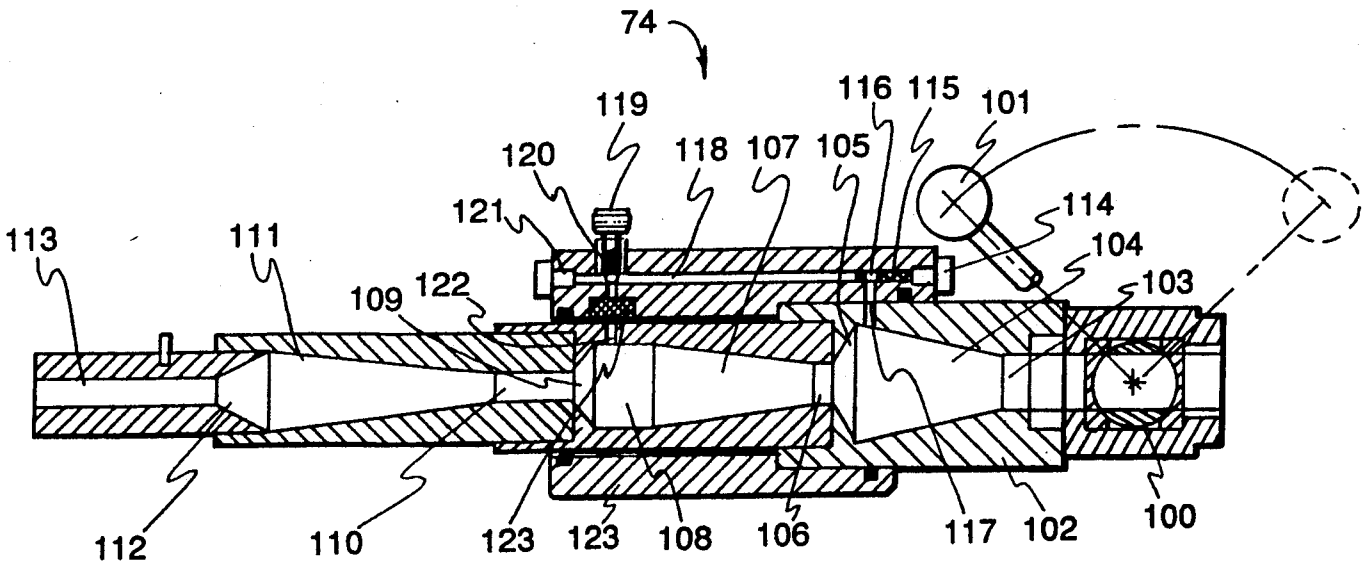
FIG. 5 is a longitudinal cross sectional view illustrating the delivery nozzle.
Figure 6:
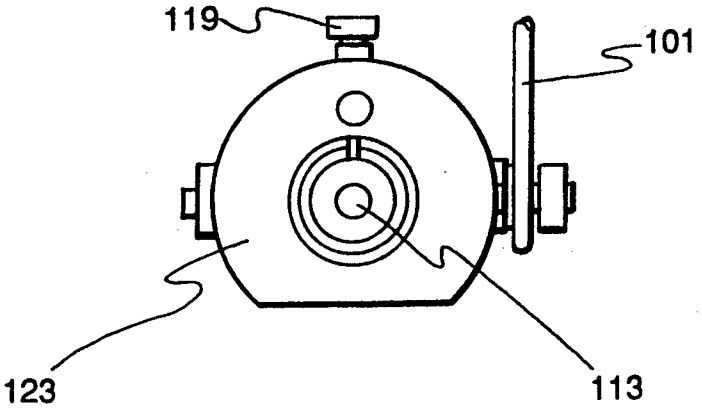
FIG. 6 is a front end view further illustrating the delivery nozzle.
Figure 8:
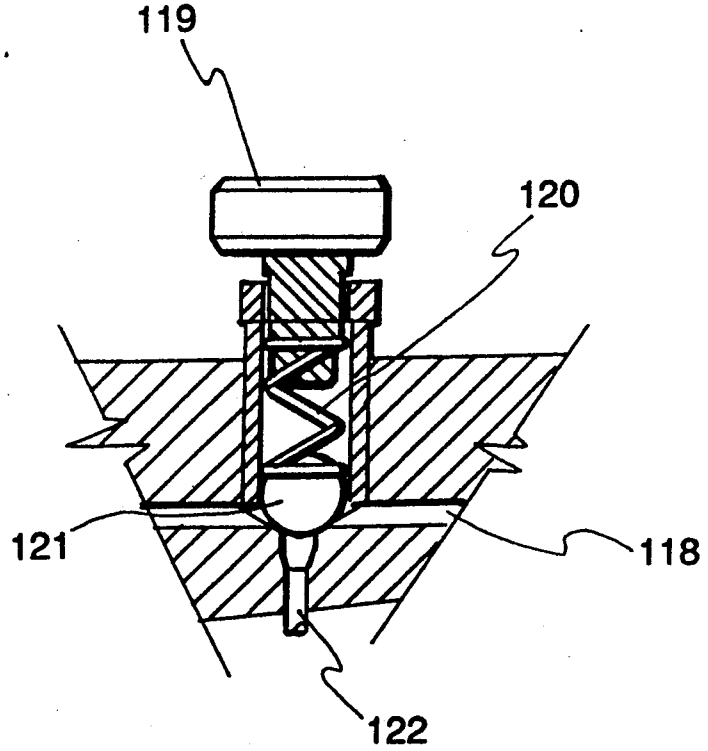
FIG. 8 is a cross-sectional detail view illustrating an adjustable spring ball check valve component of the delivery nozzle pressure imbalancing system.
Figure 7:
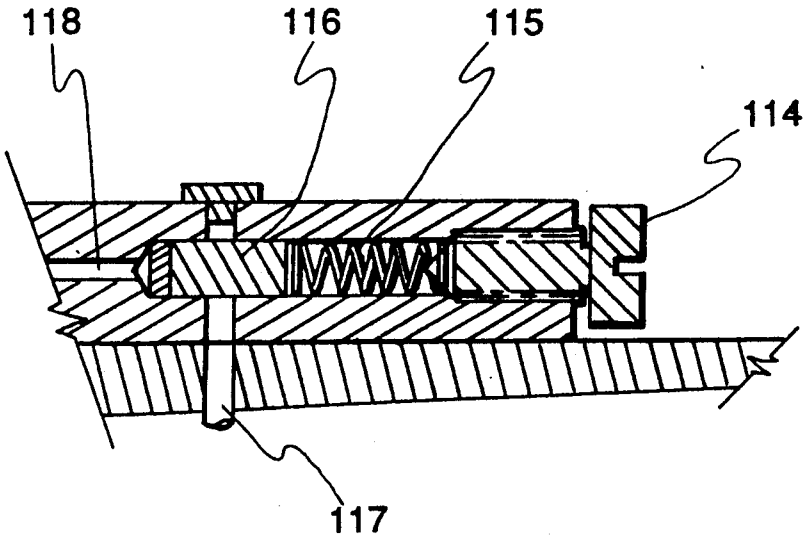
FIG. 7 is a cross-sectional detail view illustrating an adjustable spring slide check valve component of the delivery nozzle pressure imbalancing system.

As shown in FIGS. 3 and 4, the compensator 36 includes an outer cylinder 37 possessing opposite circular end walls 35 and 39, discharge ports 38, 64, and 66, and an inlet port 34 connected to the high pressure outlet 28 of regulator 26 (FIG. 1). A second coaxial inner cylinder 76 mounts a piston 77 for reciprocal sliding movement. Piston 77 includes a seal ring 78 to effect substantially air tight sealing relation of piston 77 within cylinder 76. A coil compression spring 87 surrounds piston rod 85 and abuts cylindrical bosses 88 and 89, thus biasing piston 77 toward base plate 91, to a position in which inlet port 34 is closed. Seal 86 supports piston rod 85 for reciprocal sliding movement, while preventing escape of gas around rod 85. A plurality of axially spaced vent apertures 79, 80, 81, 82, 83, and 84 are formed through cylinder 37, sequentially communicating with outer cylinder 37 as piston 77 moves away from inlet port 34. As may now be readily understood, gas will enter inlet port 34 only when the pressure at inlet port 34 is sufficient to overcome the bias of spring 87 and the pressure at ports 38, 64, and 66. Accordingly, piston 77 will slam closed due to the bias of spring 87 when the pressure at outlet ports 38, 64, and 66 equals the pressure at inlet 34.

As depicted in FIGS. 5 through 8, the delivery nozzle 74 includes a ball valve 100 actuated by manual manipulation of lever 101 to selectively open and close supply line 72 (FIG. 1). The nozzle 74 possesses a plurality of progressively smaller diameter conically tapered stepped stages for the purpose of compacting the fine solid particulate fire fighting powder into discrete solid slugs. The nitrogen and entrained agent initially enters the first outwardly conically flaring first stage loading chamber 104 and is compacted and sheared at an inwardly tapering first stage throat 105 prior to passage through a reduced diameter inlet 106 of a second outwardly conically flaring first stage relief chamber 107. The solid particulate agent is collected and compacted in a circular second stage loading chamber 108 prior to being further compressed in a tapering second stage throat 109. The compacted particulate slug is then sheared as it passes through a reduced diameter cylindrical section 110. The compacted agent then travels through outwardly flaring second stage relief chamber 111 and tapering third stage throat 112 to discharge passage 113, through which it is ejected at speed near or above Mach 1.

In order to facilitate compaction of the agent into discrete slugs within the nozzle 74, a pressure imbalance system 123 includes interconnecting gas ports 117, 118, and 122. If pressure Within second stage loading chamber 108 exceeds pressure within first stage loading chamber 104 plus the bias of springs 120 and 115, ball check valve 121 (FIG. 8) lifts, allowing gas to flow back through ports 122 and 118. A screen 123 filters out agent, allowing back flow of only gas. Slide check valve 116 (FIG. 7) then retracts against the bias of spring 115, allowing the gas to jet back to section 104. Screws 114 (FIG. 7) and 119 (FIG. 8) allow manual adjustment of the release pressures of the check valves 116 and 121 for fine tuning of nozzle operation. The nozzle 74 is thus configured with three separate stages of different lengths and diameters which are operative to sequentially mold the agent, in phases, to the finished product in the form of a quasi-projectile or slug.

In order to facilitate a complete understanding of the manner of operation, the follow description is provided. High pressure gas is initially delivered from tanks 12 and 14 through regulator 26 and compensator 36 to vessel 50 (FIG. 1). In this condition, prior to opening of valve 70, all components from the regulator 26 to the vessel 50, including the pressure sink 44, are stabilized at an equal pressure and valve 40 will be closed. The system pressure is equal to the high pressure regulator output 28 pressure, minus the compensator spring 87 (FIG. 3) override pressure, typically selected at about 20 psi. When pneumatic valve 70 is closed by manual actuation of low pressure control valve 25 (FIG. 1), agent is inducted into a nitrogen gas stream from reservoir 54 (FIG. 2), through spout 75 and tube 69 into outlet 68, through valve 70 and into hose 72 supplying nozzle 74. As this effect occurs, there is a disproportionately small quantity of agent to volume of gas, due to a number of factors including the radically different specific gravities of the agent and the gas. To achieve an effective balance of agent to gas in the discharge stream, the compensator 36 (FIG. 1) senses pressure changes through back pressure effects and adjusts gas flow accordingly.

Ullage pressure in vessel 50 reduces rapidly as the supply hose 72 fills with a gas and agent mixture. This pressure drop is sensed at ports 64 and 66 of compensator 36 (but not immediately at port 38 because valve 40 was initially closed) tending to cause piston 77 (FIG. 3) to snap fully open and allowing high pressure gas to flow through inlet 34 and vent apertures 79, 80, 81, 82, and 83. To avoid excess gas by pass downstream, pressure sink 44 (FIGS. 1 and 2), having a volume equal to the combined volume of hose 72, valve 70, outlet 68, tube 69 and spout 75, substantially immediately dumps make-up gas into vessel 50. This added gas volume reduces the impact of the pressure drop sensed by the compensator 36, in effect functioning as a shock absorber. Valve 40 then opens due to the pressure differential between sink 44 and vessel 50, allowing the sink 44 to refill through port 38 of compensator 36. The immediate supply of make-up gas from sink 44 causes piston 77 (FIG. 3) of compensator 36 to close to an extent effective to reduce flow through lines 60 and 62, preventing unwanted pocketing and by-pass turbulence and promoting the smooth flow of agent to and along the hose 72.

As the vessel 50 and sink 44 are brought to operating pressure, the piston 77 of compensator 36 closes the vent apertures 79, 80, 81, 82, and 83. The system is now pressurized to the pressure of the outlet 28 of the high pressure stage of the regulator 26, minus the 20 psi pressure of spring 87.

In order to apply agent to a fire, the operator then opens valve 100 (FIG. 5) of nozzle 74 using lever 101. Agent and gas enter first stage loading chamber 104 through passage 103 from valve 100 and hose 72. The agent is then compressed by passage through first stage compression throat 105, and sheared by passage through reduced diameter stage one outlet 106. The sheared or remaining agent back loads first stage loading chamber 104.

In a standard multi-stage venturi nozzle, a reduced diameter column of agent will stabilize in the throats of the nozzle stages, and the sheared residue in each loading chamber will stagnate in the periphery of the cone. Accordingly, such nozzles are not capable of delivering a high velocity stream of compacted particulate agent slugs. Additionally, percolation tending to loosen or fluff the agent within the nozzle will occur due to gas slippage (flow of gas without entrained agent) from stage to stage.

In order to overcome these problems, the present invention provides a pressure imbalancing mechanism which creates impulses of recycling discharge pressure from stage one relief chamber 108 to the stage one compression throat 105, which in turn momentarily collapses the pressure in the stage two throat 109 allowing the peripheral agent to collapse within relief chamber 111 and commence a repressurizing phase prior to breakthrough into the third stage throat 112. Specifically, after passage of the initial column of agent into second stage throat 109, the throat 109 will partially clog, resulting in a pressure in second stage loading chamber 108 which is higher than the pressure in first stage loading chamber 104 adjacent the junction with first stage throat 105. Due to this higher pressure, gas (but not agent due to screen 123) will back flow through port 122, check valve 121 (FIG. 8), port 118, check valve 116 (FIG. 7), and port 117 to loading chamber 104. This increased pressure in loading chamber 104 will causes the previously sheared agent to collapse into first stage throat 105, temporarily increasing the pressure at port 117 above the pressure at port 122, thus closing check valves 116 and 121 and stopping back flow. The pulsating action of the nozzle can be fine tuned in operation by manipulation of check valve adjustment screws 114 and 119.

Simultaneously with the reduction of pressure in first stage loading chamber 104 caused by passage of the particulate column from throat 105 through outlet 106, and resulting back flow from relief chamber 108 through port 117, the compensator 36 senses the pressure drop and responds by opening piston 77 to increase gas flow accordingly. Similarly, compensator 36 operates to reduce gas flow when pressure in first stage loading chamber 104 increases.

The particulate agent is then further sequentially compacted and molded as it passes from stage two throat 109 through passage 110 to stage two relief 111 and into stage three throat 112. Ambient atmospheric pressure provides a small but effective pressure barrier at the discharge orifice 113 for final compression of the particulate slug prior to discharge from the nozzle. Frictional effects of the gas and particulate flow through the nozzle results in substantial heating, which partially melts the silicone constituent of the fire fighting agent, contributing to the cohesiveness of the discharged slug as it passes through the ambient pressure wall and turbulence at the bounds of the fire envelope. It should be understood that the discrete slugs of compacted agent are discharged in a continuous very high speed stream, on the order of Mach 1.

Because the possibility of deploying a flexible fire agent delivery hose in the same configuration on any two occasions is extremely remote, a different set of flow characteristic equations exist each time the hose 72 is deployed. In the absence of a control method to sense the differentials of internal friction, gas pockets, and curves in the hose, there is a natural tendency for the gas to overtake the agent and create turbulence where it is not desired for a loaded discharge. These physical anomalies are considerably reduced by the back pressure action and pulsation of the nozzle, which promote a uniform compaction and discharge of compacted agent slugs. As the system comes up to design operating pressure, the interplay between the nozzle and the compensator 36 through the captive pneumatics of the system act to considerably reduce undesirable effects in agent flow characteristics.

It is to be understood, however, that even though numerous characteristics and advantages of the present invention have been set forth in the foregoing description, together with details of the structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed.

What is claimed is:

1. An apparatus for delivering compressed particulate solid fire fighting agent, comprising:

means for storing a quantity of fire fighting agent;

means for supplying a pressurized gas stream;

means for entraining said agent in said pressurized gas stream; and means for compacting said agent into quasi-discrete slugs and for ejecting said slugs at a high velocity.

2. The apparatus of claim 1, further comprising compensator means for regulating gas flow to said means for storing a quantity of fire fighting agent depending upon sensed pressure conditions.

3. The apparatus of claim 1, further comprising sink means for substantially immediately supplying a quantity of make up gas to said means for storing a quantity of fire fighting agent upon an initial discharge of gas and agent.

4. The apparatus of claim 1, wherein said means for compacting said agent includes a multi-stage nozzle.

5. The apparatus of claim 4, wherein said nozzle includes a plurality of compression throats.

6. The apparatus of claim 5, further comprising pressure feed back means for allowing back flow of gas between at least two of said compression throats.

7. The apparatus of claim 6, wherein said pressure feed back means includes at least one check valve.

8. An apparatus for delivering compressed particulate solid fire fighting agent, comprising:

a vessel for storing a quantity of fire fighting agent;

a supplying source for supplying a pressurized gas stream to said vessel;

a discharge tube communicating with said supply source for entraining said agent in said pressurized gas stream; and a nozzle communicating with said discharge tube for compacting said agent into quasi-discrete slugs and for ejecting said slugs at a high velocity.

9. The apparatus of claim 8, further comprising a compensator for regulating gas flow to said vessel depending upon sensed pressure conditions.

10. The apparatus of claim 9, wherein said compensator includes a spring biased piston operative to sequentially open a plurality of axially spaced vent apertures to regulate gas flow.

11. The apparatus of claim 8, further comprising a pressure sink for substantially immediately supplying a quantity of make up gas to said vessel upon an initial discharge of gas and agent.

12. The apparatus of claim 11, wherein said pressure sink possesses a volume substantially equal to a volume of a downstream flow path from said vessel to said nozzle.

13. The apparatus of claim 8, wherein said nozzle includes a plurality of stages.

14. The apparatus of claim 13, wherein said nozzle includes a plurality of compression throats.

15. The apparatus of claim 14, further comprising a pressure imbalance mechanism for allowing back flow of gas between at least two of said compression throats.

16. The apparatus of claim 15, wherein said pressure imbalance mechanism includes at least one check valve.

17. A method of delivering a solid particulate fire fighting agent, comprising the steps of:

entraining said solid particulate fire fighting agent in a pressurized gas stream;

compacting said solid particulate fire fighting agent into quasi-discrete slugs in a multi-stage nozzle;

discharging said slugs from said nozzle in a substantially continuous high speed stream.

18. The method of claim 17, wherein said stream has a velocity of at least Mach 1.

* * * * *